US007586467B2

(12) United States Patent
Sakano et al.

(10) Patent No.: US 7,586,467 B2
(45) Date of Patent: Sep. 8, 2009

(54) LOAD DRIVE CIRCUIT, INTEGRATED CIRCUIT, AND PLASMA DISPLAY

(75) Inventors: Junichi Sakano, Hitachi (JP); Kenji Hara, Hitachi (JP); Mutsuhiro Mori, Mito (JP)

(73) Assignees: Hitachi, Ltd., Tokyo (JP); Advanced PDP Development Center Corporation, Tokyo (JP)

( * ) Notice: Subject to any disclaimer, the term of this patent is extended or adjusted under 35 U.S.C. 154(b) by 653 days.

(21) Appl. No.: 11/434,913

(22) Filed: May 17, 2006

(65) Prior Publication Data

US 2006/0267408 A1 Nov. 30, 2006

(30) Foreign Application Priority Data

May 20, 2005 (JP) ..... 2005-147964

(51) Int. Cl.
*G09G 3/28* (2006.01)

(52) U.S. Cl. ..... 345/60; 345/63; 345/211; 315/169.4

(58) Field of Classification Search ..... 345/60–67, 345/211, 204, 690
See application file for complete search history.

(56) References Cited

U.S. PATENT DOCUMENTS 6,496,166 B1 * 12/2002 Onozawa et al. ..... 345/60
7,288,856 B2 * 10/2007 Thiery et al. ..... 307/127

FOREIGN PATENT DOCUMENTS

| | | |
|---|---|---|
| JP | 05-344719 | 12/1993 |
| JP | 06-120794 | 4/1994 |
| JP | 09-200017 | 7/1997 |

* cited by examiner

*Primary Examiner*—Duc Q Dinh
(74) *Attorney, Agent, or Firm*—Antonelli, Terry, Stout & Kraus, LLP.

(57) ABSTRACT

A small-sized, low-loss load drive circuit, an integrated circuit for that drive circuit, and an inexpensive plasma display using that integrated circuit. In the load drive circuit that responds to switching commands to supply a high or low voltage to a load by switching, the source-drain voltage of an output-stage n-type MOS transistor of a flip-flop is supplied between the gate and cathode of a main IGBT. In order to hold this voltage, the power source to the flip-flop is supplied from a main power source or a charge pump power circuit connected at the fixed potential point of the main power source. In addition, a discharge prevention circuit and discharge prevention elements and are provided in order that the potential of the power source can be maintained higher than the positive potential of main power source.

20 Claims, 7 Drawing Sheets

LOAD DRIVE CIRCUIT, INTEGRATED CIRCUIT, AND PLASMA DISPLAY

BACKGROUND OF THE INVENTION

The present invention relates to a load drive circuit and integrated circuit suitable for use in the scan driver and address driver of a plasma display, and to a plasma display using those circuits.

An example of the load drive circuit for use in the scan driver and address driver of the plasma display is a switching circuit disclosed in JP-A-06-120794. This load drive circuit has a high blocking voltage MOS transistor of which the gate voltage can be reduced to a lower value than the power source voltage. Thus, the semiconductor devices for this circuit can be produced at low cost. In this load drive circuit, in order to make the output level to the load "L" (low), a MOS transistor connected in parallel to the load is turned on, and in conjunction with the operation of that transistor, another MOS transistor connected at the high-potential side in series with the load is turned on. In order to turn on this high-potential side MOS transistor, it is necessary that an input signal be inverted by a level shift circuit that is formed of an input-purpose MOS transistor and input-purpose impedance and transmitted to the gate of the high-potential side MOS transistor. On the other hand, in order to make the output level to the load "H" (high), the MOS transistors are turned on/off contrary to the above.

Other examples of the load drive circuit are disclosed in, for example, JP-A-05-344719 and JP-A-09-200017. These drive circuits have, in addition to the main power source to the load, another power source for a flip-flop that is floated from the reference potential (for example, the ground potential) at one terminal of the load. This floating power source is used to drive the high-potential side MOS transistor. Specifically, the states of the flip-flop circuit are switched by the output from the above-given level shift circuit that has the switching element that is turned on/off by the pulse-shape input signal, and the gate (base) of the high-potential MOS transistor is controlled by one of the outputs of the flip-flop.

SUMMARY OF THE INVENTION

In the load drive circuit of JP-A-06-120794, when the output to the load is in "L" level period, a penetrating current flows from the power source terminal to the reference potential (the ground potential) through the impedance and MOS transistor. Therefore, when the "L" output period is long and when the voltage to the load is high, a problem of much loss occurs. In addition, since the penetrating current must be increased in order to switch at high speed, the loss increases.

In the load drive circuits of JP-A-05-344719 and JP-A-09-200017, even if the voltage to the load becomes "H" and the high-voltage side terminal potential of the floating power source is increased, the penetrating current is a pulse-like current and hence causes less loss. Therefore, even if the potential of the floating power source becomes high or when the switching speed is increased, the loss can be reduced. However, since a separate floating power source is necessary, the circuit arrangement becomes complicated. Particularly when the number of load drive circuits is increased because of necessity of a plurality of the output terminals, the number of the necessary floating power sources is the same as that of the output terminals, and hence it is difficult to integrate the load drive circuits. This problem is significant particularly in the plasma display that uses high source voltages and a large number of separate load drive circuits.

It is an object of the invention to provide a load drive circuit with a simple structure and low loss.

It is another object of the invention to provide a small-sized plasma display with low loss.

According to one aspect of the invention, there is provided a load drive circuit having a main circuit formed of first and second semiconductor switching elements that are connected in series with a main power source and of a load with which the second semiconductor switching element is connected in parallel, a switching command circuit that generates two pulse signals as switching commands to supply voltages to the load, a bistable circuit that receives the two pulse signals, switches between two stable states in response to the pulse signals, and holds the gate-emitter voltage of the first switching element at either one of the high and low voltages, and a control circuit that responds to the two pulse signals to control the second switching element to be turned on/off complementarily with the first switching element, wherein the power source to the bistable circuit is supplied from the main power source or another power source connected at the fixed potential point of the main power source, and the potential at the positive terminal of the power source to the bistable circuit is retained higher than that at the positive terminal of the main power source.

In a desirable embodiment of the invention, the power source to the switching command circuit that supplies the switching commands to the bistable circuit is also the same as that to the bistable circuit.

According to another aspect of the invention, there is provided a load drive circuit in which the power source to the bistable circuit is supplied through the switching command circuit from the main power source or another power source connected at the fixed potential point of the main power source.

According to still another aspect of the invention, there is provided a load drive circuit in which discharge blocking means is provided that blocks the voltage held within the bistable circuit and/or between the gate and emitter of the first main switching element from being discharged through the first main switching element when the reference potential of the bistable circuit is floated at the positive potential of the main power source.

A load drive circuit according to another preferred embodiment of the invention has first and second n-type IGBTs connected in series with a main power source, a load with which the second n-type IGBT is connected in parallel, a switching command circuit that includes p-type MOS transistors and generates two pulse voltages as switching commands to supply voltages to the load, a bistable circuit that switches between two stable states in response to the two pulse voltages as input power sources and that holds the gate-emitter voltage of the first n-type IGBT at either one of the high and low voltages, a control circuit that controls the second n-type IGBT to be turned on/off complementarily with the first n-type IGBT in synchronism with the two pulse voltages, and backflow blocking means that connect the source terminals of the p-type MOS transistors of the switching command circuit to the main power source.

According to desirable embodiments of the invention, it is possible to provide a low-loss and simple load drive circuit.

According to other desirable embodiments of the invention, it is possible to provide a small-sized and low-loss plasma display.

The other objects and features of the invention will be apparent in the following description of the embodiments.

DESCRIPTION OF THE EMBODIMENTS

Embodiments of the invention will be described in detail with reference to the accompanying drawings.

Figure 1:
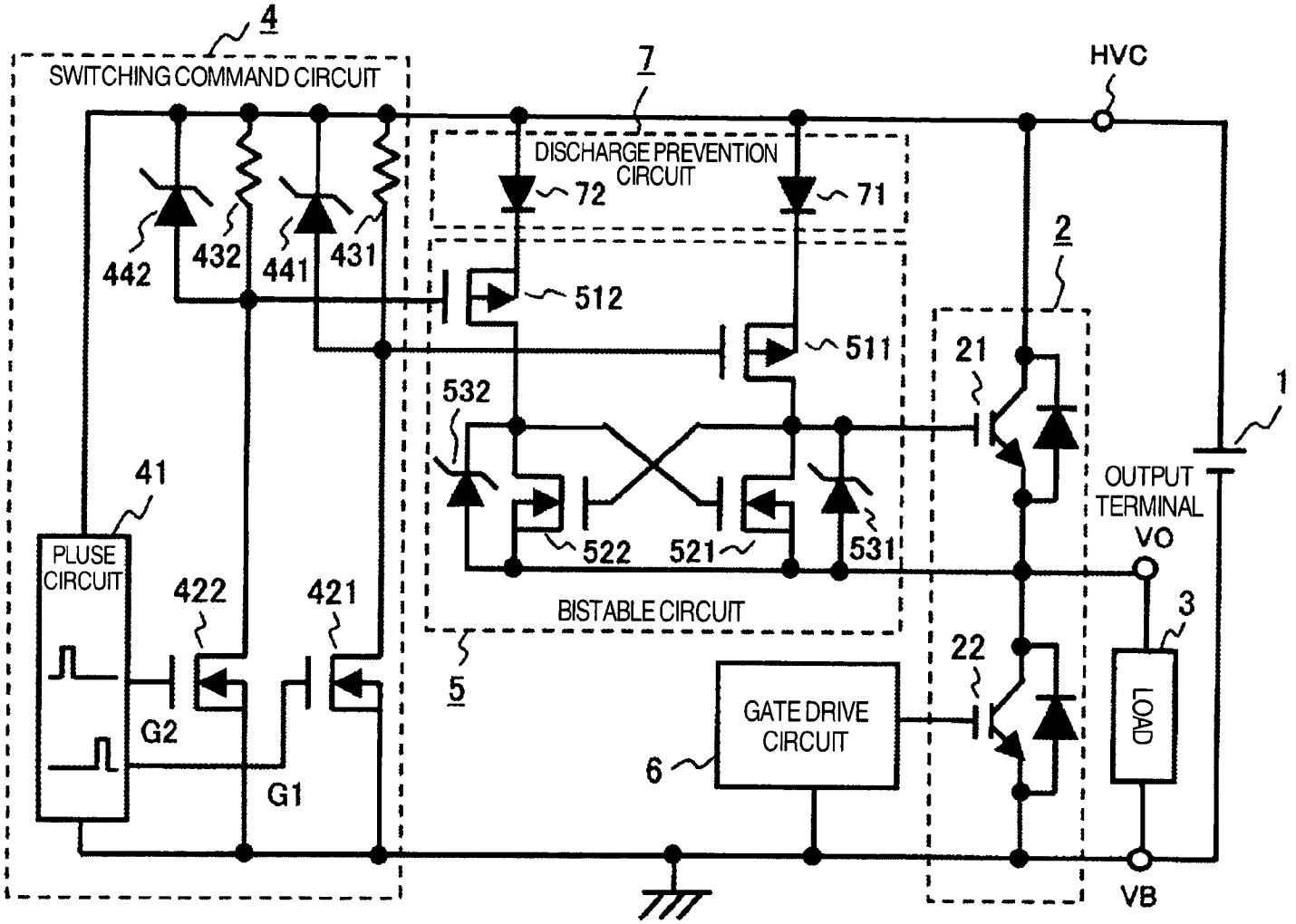
FIG. 1 is a schematic diagram showing the circuit arrangement of a load drive circuit according to the first embodiment of the invention.

FIG. 1 is a schematic diagram showing the circuit arrangement of the load drive circuit according to the first embodiment of the invention. The main circuit will be mentioned first. A first semiconductor switching element 21 and a second semiconductor-switching element 22 are connected in series across a main power source 1. The series circuit of these first and second semiconductor switching elements is called a main switching circuit 2. A load 3 is connected in parallel with the second switching element 22. This main circuit supplies a voltage of "H" (high) or "L" (low) to the load 3 by controlling the first and second semiconductor switching elements of voltage drive type to turn on and off in a complementary manner. Specifically, n-type IGBTs (Insulated Gate Bipolar Transistors) resistant to high voltages as the first and second switching elements 21 and 22 are connected in a totem-pole manner between the positive potential, HVC and reference potential, VB (for example, the ground potential) of the main power source 1. The emitter potential of the IGBT 21 is connected through an output-terminal positive pole VO to the load 3.

Next, a control circuit will be mentioned. First, the control circuit has a switching command circuit 4 that issues commands to supply a high or low voltage as the output voltage to the load 3, and a bistable circuit 5 of which the bistable states are switched by the pulse outputs from this switching command circuit 4 and one output of which is supplied to the gate-emitter path of the IGBT 21. This control circuit also has a gate drive circuit 6 that drives the IGBT 22 to turn on/off on a complementary basis relative to the IGBT 21.

The switching command circuit 4 is formed chiefly of a pulse circuit 41 for generating the switching command pulses, and a pair of switching elements, for example, n-type MOS transistors 421 and 422 that are turned on like a pulse shape by the command pulses. In addition, the switching command circuit 4 also has resistors 431 and 432 through which these switching elements 421 and 422 are connected to the power source terminal HVC, and Zener diodes 441 and 442 for clamping the voltages across them.

The bistable (flip-flop) circuit 5 has a pair of switching elements, for example, p-type MOS transistors 511 and 512 that are supplied with power from the power source positive pole HVC and turned on by the pulse signals from the switching command circuit 4. The bistable circuit 5 also has a pair of switching elements, for example, n-type MOS transistors 521 and 522 that are switched to either one of the bistable states by these signals. In addition, Zener diodes 531 and 532 are connected across the switching elements 521 and 522, respectively. Both ends of the switching element 521 that acts as one output terminal of the bistable circuit 5 are respectively connected to the gate and emitter of the main IGBT 21.

In addition, the bistable circuit 5 is connected through a discharge prevention circuit (discharge blocking means) 7, which will be described later, to the power source positive pole HVC. Specifically, this discharge prevention circuit 7 has diodes 71 and 72 for preventing the reverse current flow.

The operation will be described next. In this embodiment, a signal G1 from the pulse circuit 41 causes a high voltage to be applied to the load 3, and similarly a signal G2 causes the voltage across the load 3 to be switched to a low (zero) voltage. First, when the pulse circuit 41 generates the pulse signal G1, the switching element 421 is turned on for only a short time, thus causing a pulse-shaped voltage to produce across the resistor 431 of which the upper end is at the positive potential. Therefore, the switching element 511 of the bistable circuit 5 is turned on for only a short time, so that the bistable-switching element 521 is turned off while the switching element 522 is turned on. Thus, a voltage is applied between the base and emitter of the main switching element 21 to turn it on. On the other hand, the gate drive circuit 6 produces an output voltage of "L" in synchronism with the generation of the pulse signal G1, thus causing the main switching element 22 to be turned off. Consequently, the potential of the output terminal VO becomes "H", and thus the main supply voltage is applied across the load 3.

When the voltage to the load 3 is switched to "L", the pulse circuit 41 generates the pulse signal G2. At this time, the switching element 422 is turned on for only a short time, thus causing a pulse-shaped voltage to be developed across the resistor 432 of which the upper end is at the positive potential. Therefore, the switching element 512 of the bistable circuit 5 is turned on for only a short time, so that this time the switching element 522 is turned off while the switching element 521 is turned on. Consequently, the main switching element 21 has "L" across its base-emitter path, and thus switches to the off state. On the other hand, the gate drive circuit 6 produces an output voltage of "H" in synchronism with the generation of the pulse signal G2, thus causing the main switching element 22 to turn on. Consequently, the potential of the output terminal VO becomes "L", or the reference potential VB, so that the supply voltage to the load 3 is zero.

The retaining operation of the bistable circuit 5 and so on under the condition in which the voltage of main power source 1 is applied to the load 3 will be now described. The switching command circuit 4 only causes the above-mentioned pulse-shaped voltage to be developed across the resistor 431, and hence the switching element 511 within the bistable circuit 5 is turned on for only a short time. Therefore, when the n-type MOS transistor 522 as one of the switching elements for the bistable purpose is turned on while the other n-type MOS transistor 521 is turned off, the voltage across the transistor 521 becomes "H". This state can be maintained by the stray capacitance between the gate and source. In addition, this voltage is also applied between the base and emitter of the main IGBT 21, and maintained by the stray capacitance between the base and emitter of this main IGBT 21.

However, if a p-type LDMOS structure having a body diode between the source and drain electrodes were employed as the switching element 511 in place of the p-type MOS transistor, the following problem might occur in the absence of the discharge prevention circuit 7. That is, when the output terminal voltage VO is turned "H", the electric charges on the gate of the main IGBT 21 would be discharged through the body diode of the p-type LDMOS structure 511 and main IGBT 21. In other words, the output terminal VO, or the reference potential of the bistable circuit 5 would be raised up to the positive terminal HVC of the main power source, thus the source voltage to the bistable circuit 5 being reduced to zero. Therefore, the main IGBT 21 would have its gate-emitter voltage lowered, and thus it would be made in the off state. Accordingly, the output voltage VO would be "H", but become indefinite.

On the contrary, when the discharge prevention circuit 7 is provided as above, the above-mentioned discharge circuit is not formed, and one output voltage from the bistable circuit 5, namely, the gate-emitter voltage of the main IGBT 21 can be maintained, thus the on-state being retained. In other words, the bistable circuit functions as a latch circuit that holds the output state specified by the pulse-shaped signal G1 or G2 from the switching command circuit 4.

In this embodiment, the Zener diodes 531 and 532 prevent any excessive voltage from being applied between the gate and emitter of the main IGBT 21. Therefore, switching elements of which the gates have a low blocking voltage can be used to constitute this circuit arrangement. This suggests that it is possible to use thin gate oxides, increase the current driving ability of the main IGBT, reduce the areas of semiconductor elements, lower the cost and relatively simplify the manufacturing processes.

In addition, since the switching command circuit 4 operates to generate pulse-shaped signals, the loss due to the penetrating current flowing from the high voltage power HVC is less, and it can be kept low even if the voltage of main power source 1 is raised.

Moreover, the necessary power source is only the main power source 1 for driving the load 3. There is no need to provide the high-voltage floating power source as in the patent documents of JP-A-05-344719 and JP-A-09-200017. The load drive circuit can be simply formed of a small number of elements. Thus, a small-sized, low-loss load drive circuit can be produced at low cost.

The main IGBTs 21 and 22 may be, for example, MOSFETs as far as they are voltage drive type switching elements. In addition, the gate of the main IGBT 22 may be of course driven by the same circuit as that used in the main IGBT 21.

Since the main blocking voltage and gate blocking voltage of the transistors 521 and 522 of the bistable circuit 5 may be relatively as low as the gate blocking voltage of the main IGBTs 21 and 22, small-sized elements may be used for that circuit. In addition, since the element size of the high blocking voltage p-MOS transistors 511 and 512 within the bistable circuit 5 is relatively small, the n-type MOS transistors 421 and 422 within the switching command circuit 4 that directly drive these transistors may also be small-sized elements. Moreover, the element size of the high blocking voltage p-type MOS transistors 511 and 512, which is set according to the fixed rise time of the output terminal voltage VO, can be decreased sufficiently as compared with that of the main IGBTs 21 and 22. Therefore, when the load drive circuits are integrated, they can be produced to be small and at low cost.

Figure 2:
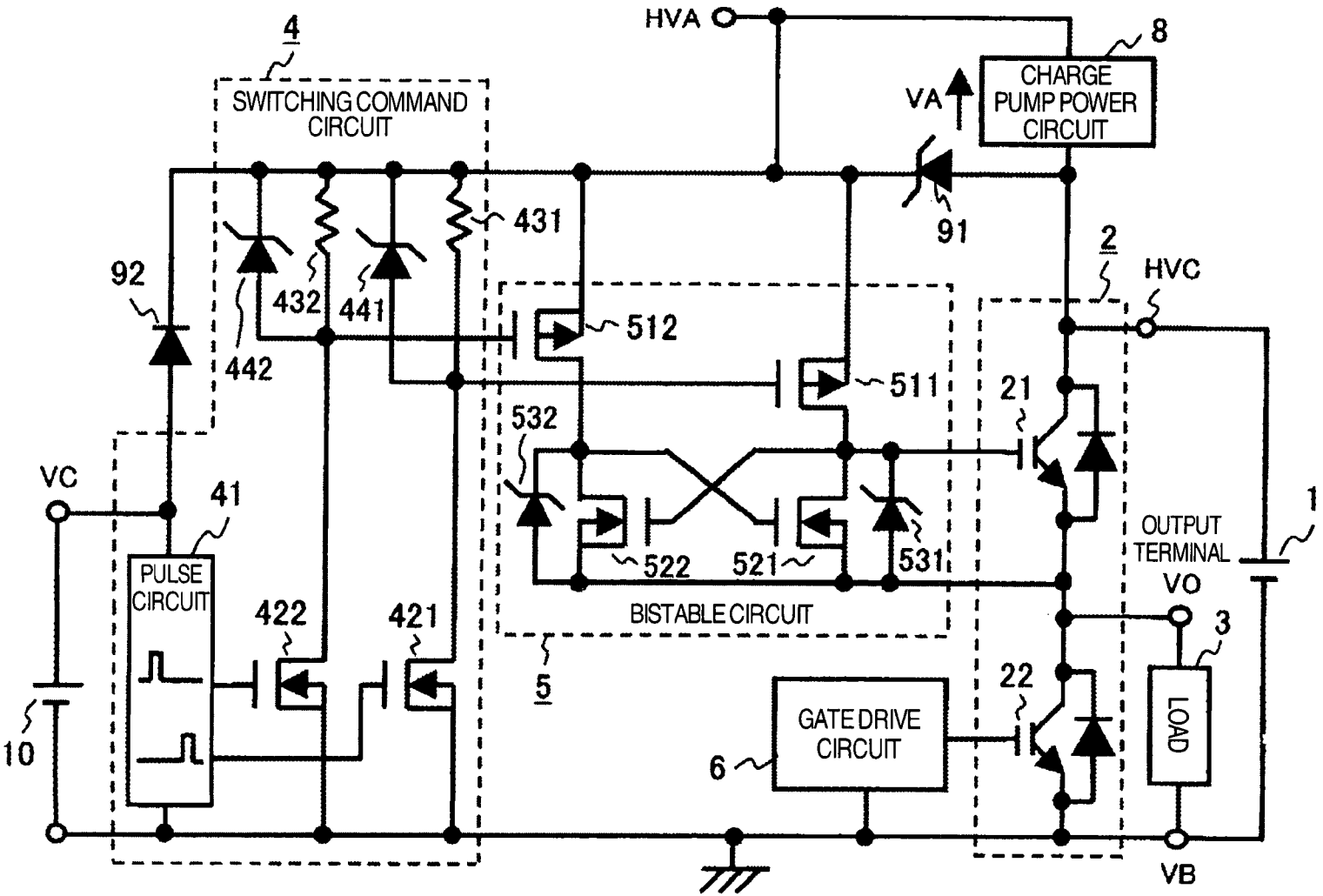
FIG. 2 is a schematic diagram showing the circuit arrangement of a load drive circuit according to the second embodiment of the invention.

FIG. 2 is a schematic diagram of the circuit arrangement of the load drive circuit according to the second embodiment of the invention. Like elements corresponding to those in FIG. 1 are identified by the same reference numerals, and will not be described. The power source terminal HVA connected to the switching command circuit 4 and bistable circuit 5 is powered from a charge pump power circuit 8 of which the reference potential corresponds to the positive potential HVC of the main power source 1. In order to avoid the problem with the voltage discharge through the bistable circuit 5 and through the gate-emitter path of the main IGBT 21 as mentioned in the section of first embodiment, a discharge prevention element 91 formed of a Zener diode is connected between the terminals HVC and HVA with its cathode connected to the HVA side. In addition, a discharge prevention element 92 formed of a high blocking voltage diode is connected between the positive VC of a power source 10 to the pulse circuit 41 and the power source terminal HVA with its cathode connected to the power source terminal HVA.

In this embodiment, the potential of the power source common to the switching command circuit 4 and bistable circuit 5 is raised by the charge pump power circuit 8 of which the reference potential corresponds to the positive HVC of main power source 1. Therefore, even if the load drive circuits have a large number of output channels, or several to 100 output channels, the single charge pump power circuit 8 will suffice, and thus the number of elements used is small. Therefore, it is easy to integrate this circuit arrangement. Moreover, the charge pump power circuit 8 connected to the positive pole HVC as the fixed potential point of the main power source 1 causes the potential of the power source to the bistable circuit 5 and switching command circuit 4 to be kept higher than that of the positive terminal HVC of main power source 1. Thus, an external DC power source can be used in place of the charge pump power circuit 8.

Under the provision of discharge prevention elements 91 and 92, even if the output terminal voltage VO becomes "H", the Zener diode 91 as a discharge prevention element counteracts, thus preventing the charges on the gate of the main IGBT 21 from flowing to the HVC side. Thus, the main IGBT 21 can be kept in the on state.

In addition, when the positive HVC of main power source 1 is being raised from 0 [V], the HVA terminal and output terminal VO are at 0 [V] and thus the main IGBT 21 is in the off state. Accordingly, the voltage HVC is increasing. At this time, there is the problem that the potential of the positive HVC of main power source 1 might be divided with a ratio of the off-state impedance of the main IGBT 21 and the load-3 impedance with the result that the output terminal voltage VO is developed across the load. The discharge prevention element 92 can solve this problem. That is, even if the power terminal HVC is being raised from 0 [V], the power terminal HVA is charged up to the potential of the power terminal VC via the discharge prevention element 92. Therefore, even at HVC=0 [V], the main IGBT 21 can be turned on in advance by the power from the power terminal VC. At this time, the discharge prevention element 91 prevents current from flowing from the power terminal VC to the positive HVC of the main power source. If the potential of positive HVC is raised after the main IGBT 21 is turned on, the discharge prevention element 92 counteracts, thus preventing current from flowing from the positive HVC of the main power source to the power source 10 for the pulse circuit 41. Since the main IGBT 21 is in the on state, the output terminal voltage VO can increase to a voltage that follows the positive HVC voltage minus the on-voltage drop in the main IGBT 21 due to the current flowing in the load 3, but finally increase up to the voltage of main power source 1. Therefore, there is no problem that the output voltage VO increases when the main power source 1 is rising up as described above. At this time, the gate voltage of the main IGBT 21 can be kept higher than the HVC potential by the counteraction of discharge prevention element 91, and the discharge prevention element 91 maintains its on state.

The discharge prevention element 91 can serve both as itself and an electrostatic breakdown prevention element, and thus suppress the increase of the element area. In addition, since the discharge prevention element 92 can be used as a single common element even if a plurality of load drive circuits are integrated as a semiconductor integrated circuit, the load drive circuits can be produced with the element area prevented from being increased, and at low cost.

Figure 3:
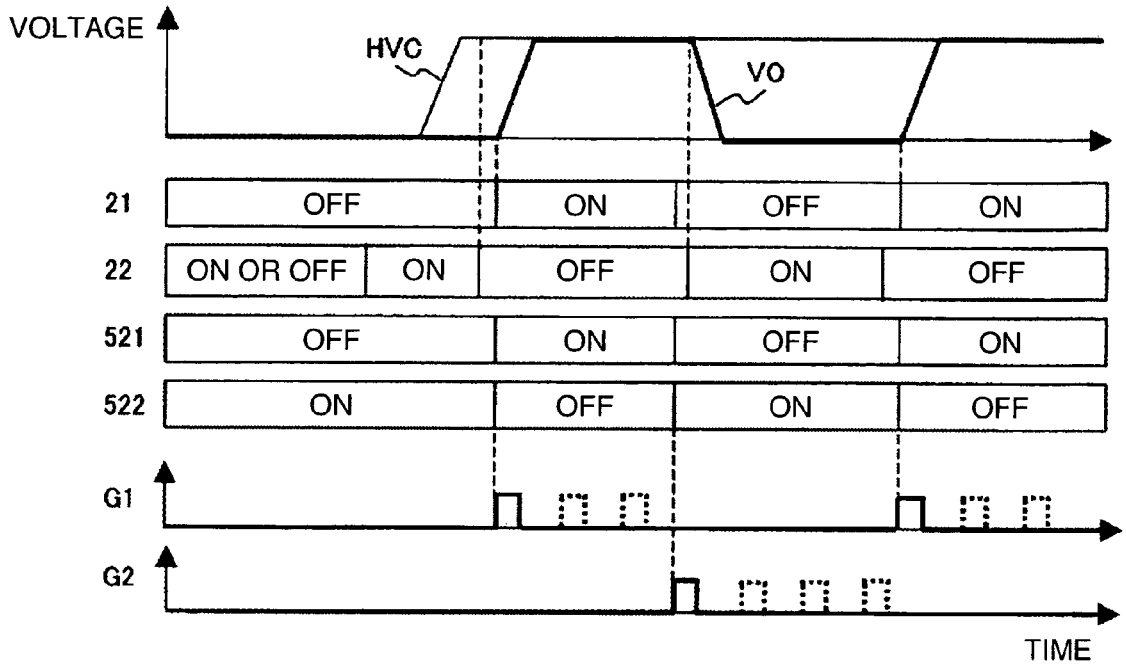
FIG. 3 is a timing chart showing the sequence of the drive operations of the load drive circuit according to the second embodiment of the invention.

FIG. 3 is a timing chart showing the sequence of drive operations such as voltage waveforms and on/off of elements in the embodiment shown in FIG. 2. The main IGBTs 21 and 22 are turned on/off by making the pulse signals G1 and G2 from the pulse circuit 41 be turned "H" in a pulse shape.

At this time, when the charge pump power circuit 8 is not provided, it is desirable to set the pulse width so that the pulse signal G1 is turned "L" before the potential of the power terminal HVA exceeds the HVC potential when the output voltage VO is switched from "L" to "H". If the pulse width were long enough that the pulse signal G1 continued "H" even after the HVA potential exceeded the HVC potential, current might flow from the terminal HVA through the resistor 431 and transistor 421, lowering the gate voltage of main IGBT 21 so that the on-voltage across the main IGBT 21 would increase.

In addition, if the pulse signal G1 is previously caused to be "H" for a much longer period when the HVC potential is being raised from 0 V, the main IGBT 21 can be turned off. Therefore, it is necessary, after the main IGBT 22 is turned on, to raise the HVC potential and then to turn on the main IGBT 21. Consequently, even if the charge pump power circuit 8 and discharge prevention elements 91 and 92 are not provided, the potential of the output terminal VO is not indefinite during the HVC potential rise, and thus the above problem does not occur. In other words, the main IGBT (the second semiconductor switching element) 22 is turned on before the voltage of main power source 1 is raised, and the main IGBT 21 is allowed to turn on after the voltage of main power source 1 has risen up to a predetermined voltage.

Incidentally, as indicated by the broken lines in FIG. 3, the command pulse signals of G1 and G2 are repetitively produced with a certain period to update the states of the elements during the period of the same state. The reason is that, as described above, the voltage of the bistable circuit 5 could be reduced by the leak current flowing through the elements when the discharge prevention circuit 7 shown in FIG. 1 and the discharge prevention elements 91 and 92 shown in FIG. 2 are not provided and when the state-holding time becomes long. To cope with this problem, if the updating command pulse is repetitively produced to periodically supply power, the output voltage from the bistable circuit 5 can be prevented from being reduced even if the state sustaining time becomes long, and thus the load 3 can be stably driven. In addition, for this purpose, a capacitor may be connected between the gate and source of each of the switching elements 521 and 522 of bistable circuit 5, and in that case the same effect can be expected.

Figure 4:
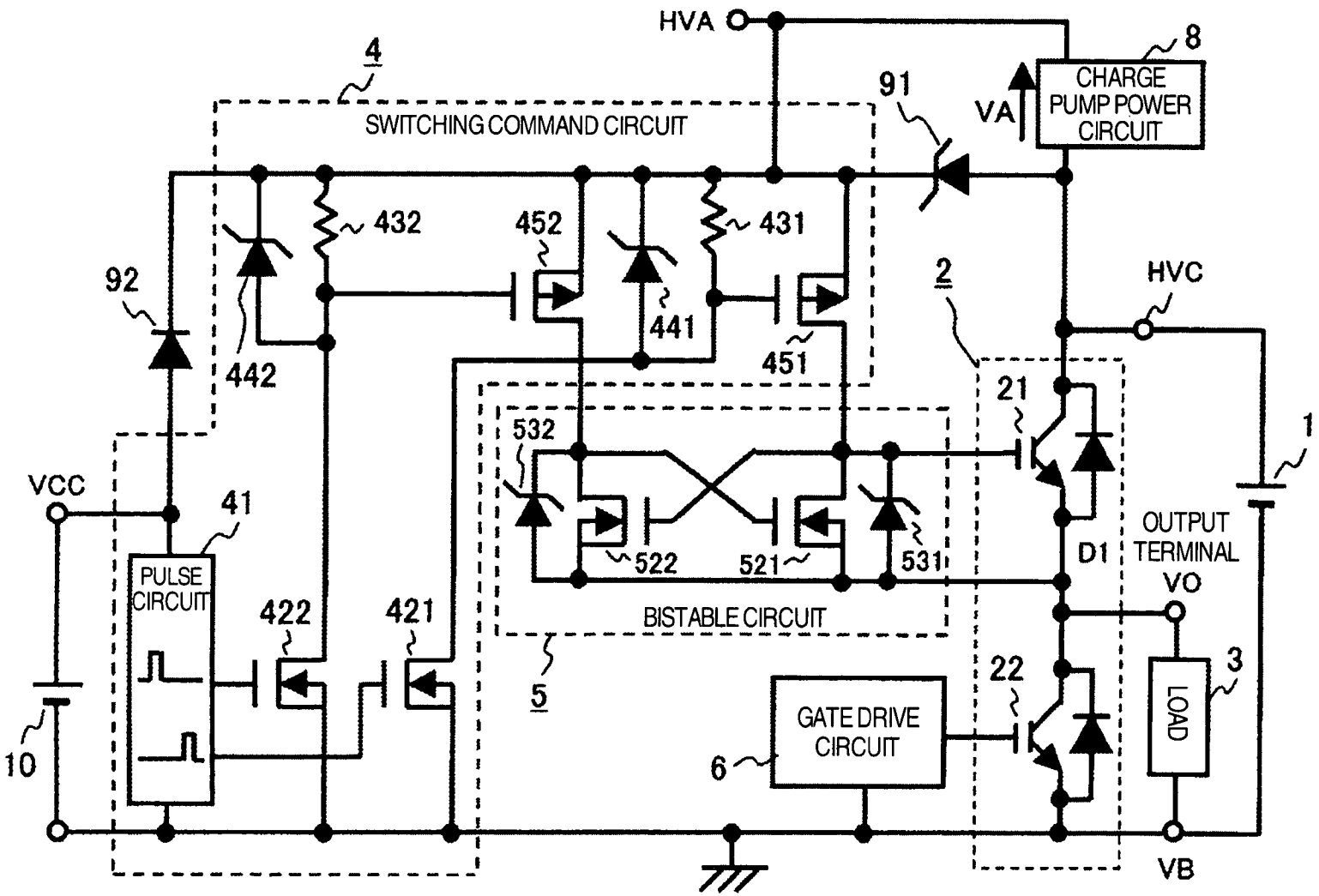
FIG. 4 is a schematic diagram showing the circuit arrangement of a load drive circuit according to the third embodiment of the invention.

FIG. 4 is a schematic diagram of the circuit arrangement of the load drive circuit according to the third embodiment of the invention. Like elements corresponding to those in FIGS. 1 and 2 are identified by the same reference numerals, and will not be described. In the second embodiment mentioned above with reference to FIG. 2, the switching command circuit 4 transmits only the switching command signals to the bistable circuit 5, and the switching command circuit 4 and bistable circuit 5 have the common power source HVA. Specifically, the pulse voltages across the resistors 431, 432 within the switching command circuit 4 are transmitted as control signals to the source-gate paths of p-type MOS transistors 511, 512 within the bistable circuit 5.

On the contrary, the embodiment shown in FIG. 4 is different from that shown in FIG. 2 in that the power to the bistable circuit 5 is also supplied through the switching command circuit 4. Specifically, p-type MOS transistors 451 and 452 are provided within the switching command circuit 4, and the pulse voltages both as control signal and as power source voltage are supplied to the bistable circuit 5 through the p-type MOS transistors 451 and 452 from the power terminal HVA.

The other points than this feature are exactly the same as those including the operations in the embodiment shown in FIG. 2, and the same effects of actions can be achieved.

Figure 5:
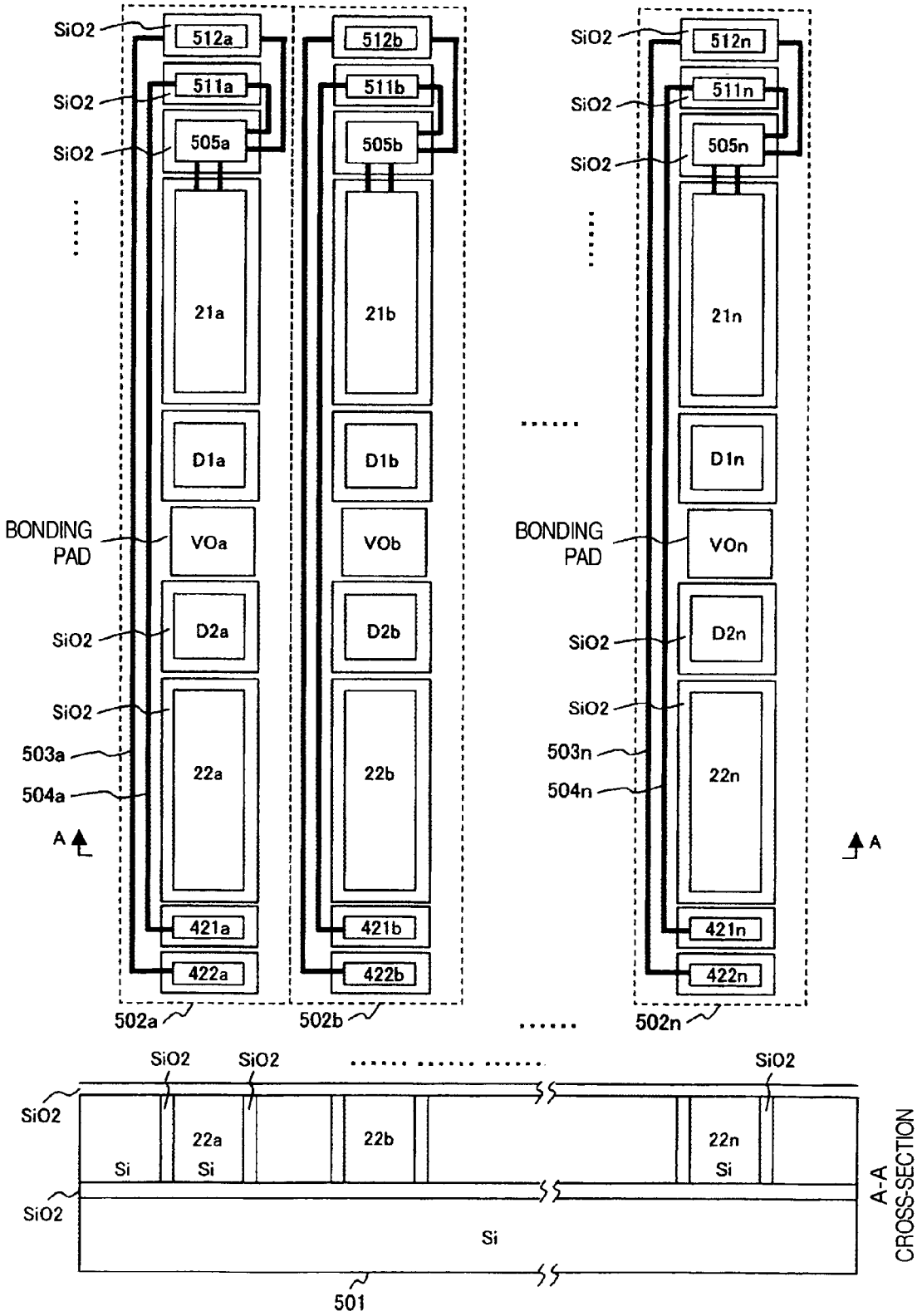
FIG. 5 is a diagram showing an example of the structure of the load drive circuits integrated on a semiconductor substrate according to the invention.

FIG. 5 is a diagram showing an example of the structure of the load drive circuits integrated on a semiconductor substrate according to the invention. In this example, n load drive circuits of output channels 502*a*-502*n* are formed on a silicon-on-insulator (SOI) substrate 501 with an insulating film such as silicon oxide $SiO_2$ provided between the elements to isolate the elements. This structure has bonding pads VOa-Von as the electrodes of output terminals at the center, main IGBTs 21*a*-21*n* on the high potential side, their back-to-back connected diodes D1*a*-D1*n*, main IGBTs 22*a*-22*n* on the reference potential side, and their back-to-back diodes D2*a*-D2*n*. Shown at 503*a*-503*n* and 504*a*-504*n* are the wiring conductors, and 505*a*-505*n* the groups of integrated resistors, Zener diodes and transistors that include the resistors 431, 432, Zener diodes 441, 442, 531, 532 and n-type MOS transistors 521, 522 for each channel a-n.

This array structure enables the wiring region to be minimized, and the stray capacitance between high-voltage elements to be reduced. In addition, since the insulating films are provided to isolate the elements, it is possible to reduce the stray capacitance and lower the current value when the pulses drive the elements. Thus, it is possible to further reduce the loss, element size and cost.

Figure 6:
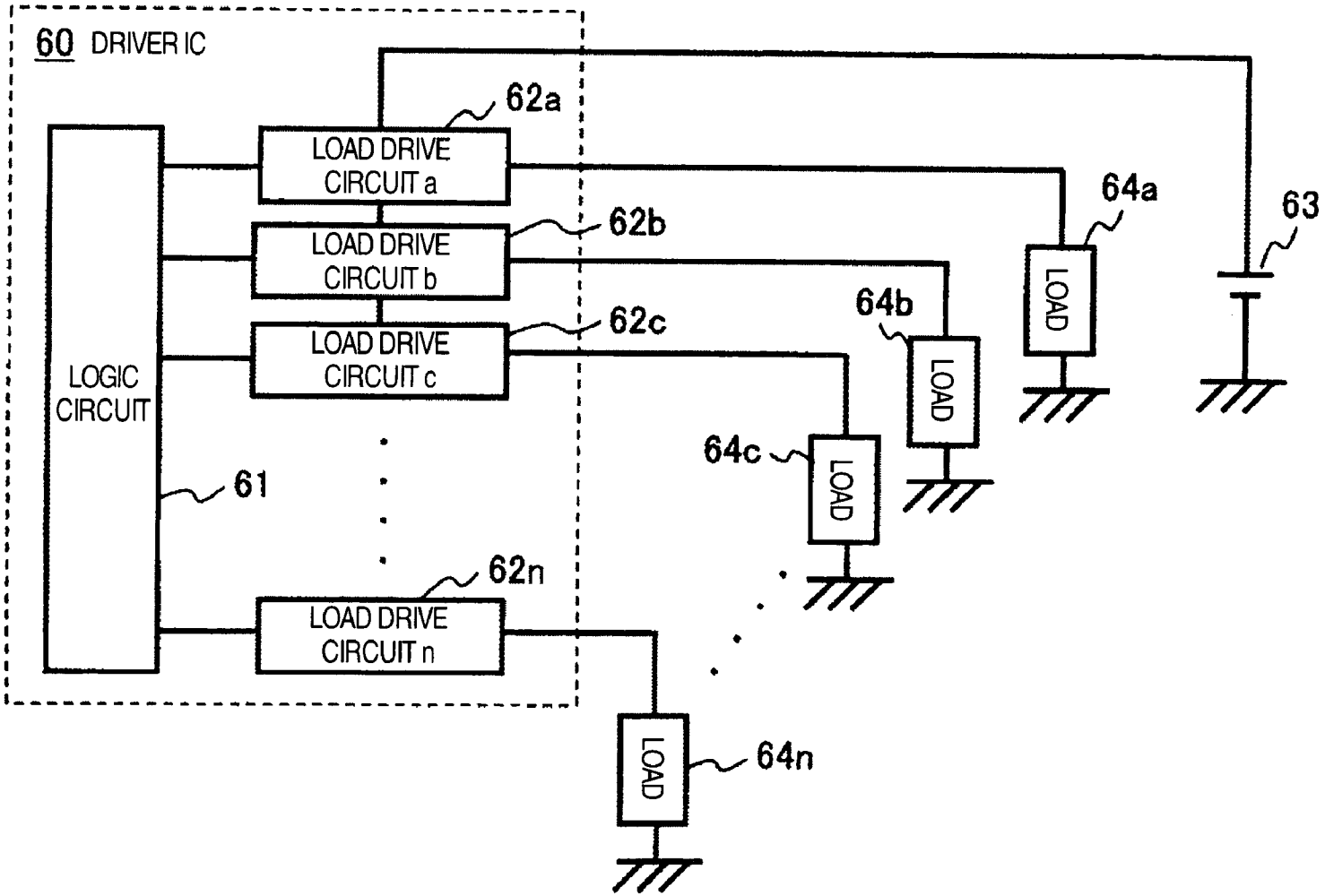
FIG. 6 is a block diagram showing an example of the structure of a driver IC for a plasma display according to the invention.

FIG. 6 is a block diagram showing an example of the construction of the drive circuits integrated as a capacitive load driver IC for plasma display according to the invention. A driver IC 60 is an integrated circuit that has, as illustrated, a logic circuit 61 that specifies the output states of "H" and "L" of each load drive circuit, and load drive circuits 62*a*-62*n* (n=tens to hundreds) for tens to hundreds of channels. The load drive circuits 62*a*-62*n* within this driver IC 60 are powered from a power source 63 to drive loads 64*a*-64*n*.

Integration of the load drive circuits according to the embodiments of the invention can produce the small-sized and low-loss driver IC 60 for plasma display.

Figure 7:
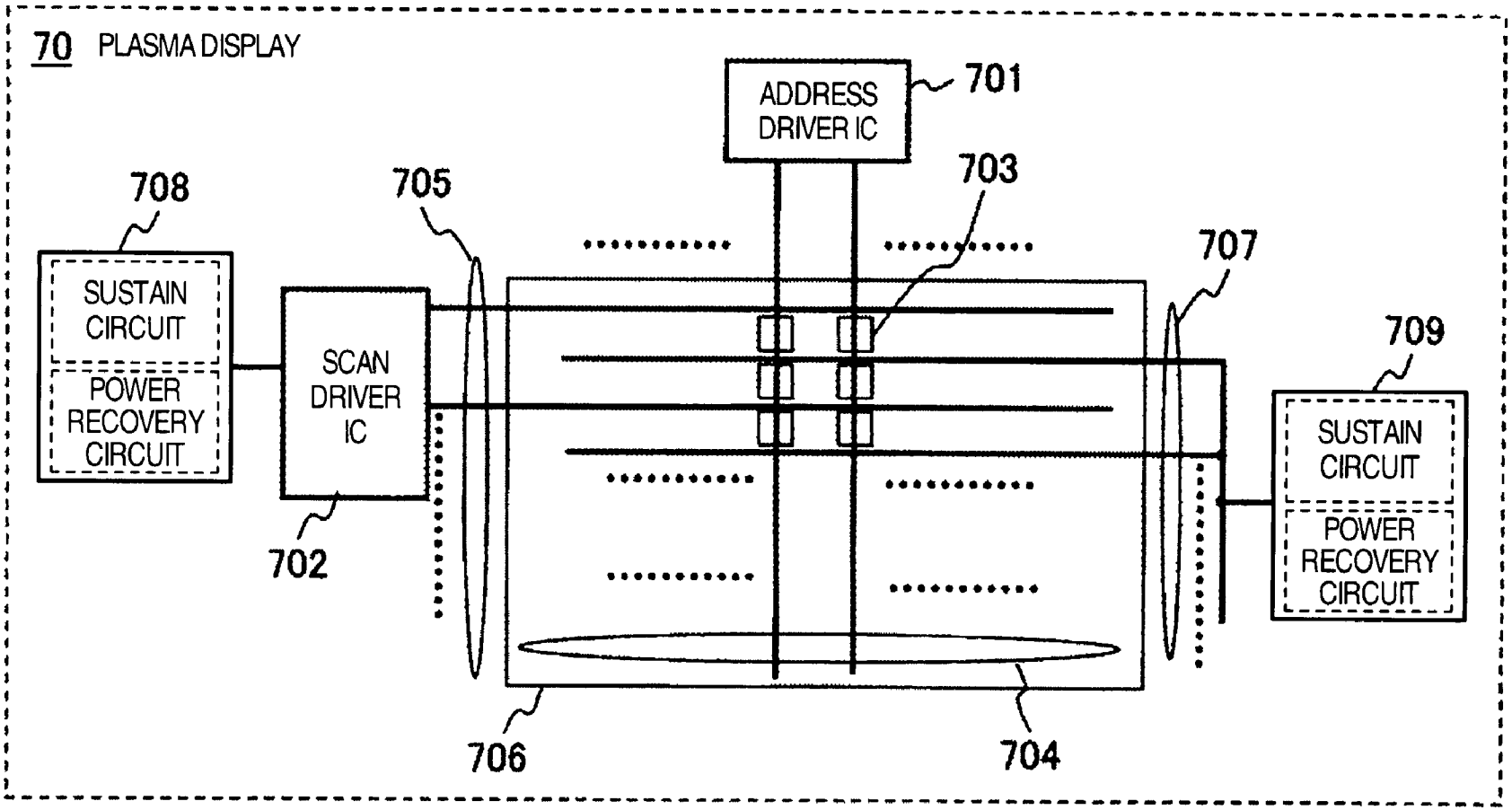
FIG. 7 is a schematic diagram showing an example of the plasma display according to the invention.

FIG. 7 is a diagram showing an example of the construction of a plasma display that uses driver circuits produced by integrating the load drive circuits according to the invention. In this example, an address driver IC 701 and scan driver IC 702 within a plasma display 70 employ the load drive circuits according to the embodiments of the invention. First, the address driver IC 701 serves as a scan circuit that applies a scanning signal for writing the designated ones of the light emitting pixel cells of plasma display 70, or it drives the address wiring conductors so that the selected data of vertical address electrodes 704 connected to the pixels 703 can be produced. Secondly, the scan driver IC 702 drives lateral Y-scanning electrodes 705 to write the designated ones of the light-emitting pixel cells 703. Shown at 706 is the plasma display panel, 707 the X-electrodes, and 708 and 709 the sustain circuit and power recovery circuit, respectively.

According to this example, use of small-sized and low-loss load drive circuits enables the plasma display to reduce the loss. The simplification of IC's heat radiation leads to the small size, weight saving and low cost of drive circuits.

The present invention is not limited to the above embodiments, but of course can be variously changed without departing from the scope of the invention.

The invention claimed is:

1. A load drive circuit using voltage-drive type semiconductor switching elements to supply high and low voltages to a load, said load drive circuit comprising:

first and second semiconductor switching elements connected in series with a main power source;

said load connected in parallel with said second semiconductor switching element;

a switching command circuit that generates two pulse signals as switching commands to supply voltages to said load;

a bistable circuit that is switched between two stable states in response to said two pulse signals and that holds a gate-emitter voltage of said first semiconductor switching element at either one of said high and low voltages; and a control circuit that responds to said two pulse signals to control said second semiconductor switching element to be turned on/off complementary with said first semiconductor switching element, wherein a power source to said bistable circuit is supplied from said main power source or another power source connected to a fixed potential point of said main power source, and a potential of a positive terminal of said source power to said bistable circuit is maintained higher than that of a positive terminal of said main power source.

2. The load drive circuit according to claim 1, wherein a power source to said switching command circuit is a same as that to said bistable circuit.

3. The load drive circuit according to claim 1, wherein the power source to said bistable circuit is supplied through said switching command circuit from said main power source or another power source connected to said fixed potential point of said main power source.

4. The load drive circuit according to claim 1, wherein a short-circuit prevention diode is further provided to prevent said first semiconductor switching element from shunting a voltage across output terminals of said bistable circuit that is applied between a gate and an emitter of said first semiconductor switching element.

5. The load drive circuit according to claim 4, wherein said short-circuit prevention diode is a Zener diode.

6. The load drive circuit according to claim 1, wherein said other power source is a charge pump power circuit of which a reference potential is a positive potential of said main power source.

7. The load drive circuit according to claim 1, further comprising:

means for turning on said second semiconductor switching element before a voltage of said main power source is risen up; and means for allowing said first semiconductor switching element to be turned on after the voltage of said main power source has risen up to a predetermined voltage.

8. The load drive circuit according to claim 1, wherein said switching command circuit has an update pulse generator that periodically updates an on state and/or an off state of said first and/or second semiconductor switching element.

9. An integrated circuit for said load drive circuits according to claim 1, said integrated circuit being formed by integrating semiconductor elements that constitute a main switching circuit that includes said first and second semiconductor switching elements, said switching command circuit and said bistable circuit on a semiconductor substrate with said elements isolated by insulating films.

10. A plasma display using said integrated circuit according to claim 9, said integrated circuit including a scan circuit to apply a scanning signal for writing the designated ones of light-emitting cells and/or an address circuit to specify the presence or absence of the light emission of each pixel cell.

11. A load drive circuit using voltage-drive type semiconductor switching elements to supply high and low voltages to a load, said load drive circuit comprising:

first and second n-type IGBTs connected in series with a main power source;

said load connected in parallel with said second n-type IGBT;

a switching command circuit that includes n-type MOS transistors and generates two pulse voltages as switching commands to supply voltages to said load;

a bistable circuit that is switched between two stable states in response to said two pulse voltages as input power sources and that holds a gate-emitter voltage of said first n-type IGBT at either one of said high and low voltages;

a control circuit that controls said second n-type IGBT to be synchronized with said two pulse voltages and turned on/off complementarily with said first n-type IGBT; and backflow blocking means that connects a source terminal of said n-type MOS transistors of said switching command circuit to said main power source.

12. A load drive circuit using voltage-drive type semiconductor switching elements to supply high and low voltages to a load, said load drive circuit comprising:

first and second semiconductor switching elements connected in series with a main power source;

said load connected in parallel with said second semiconductor switching element;

a switching command circuit that generates two pulse signals as switching commands to supply voltages to said load;

a bistable circuit that is switched between two stable states in response to said two pulse voltages and that holds a control voltage to said first semiconductor switching element at either one of said high and low voltages in accordance with said stable state; and a control circuit that controls said second semiconductor switching element to be synchronized with said two pulse voltages and turned on/off complementarily with said first semiconductor switching element, wherein discharge blocking means is further provided to block an output voltage sustained within said bistable circuit from being discharged through said first semiconductor switching element when a reference potential of said bistable circuit is floated at a positive potential of said main power source.

13. The load drive circuit according to claim 12, wherein a power source to said switching command circuit is a same as that to said bistable circuit.

14. The load drive circuit according to claim 12, wherein a power source to said bistable circuit is supplied through said switching command circuit from said main power source or another power source connected at a fixed potential point of said main power source.

15. The load drive circuit according to claim 12, wherein said discharge blocking means is a Zener diode.

16. The load drive circuit according to claim 12, wherein a positive terminal of said power source to said bistable circuit and/or said switching command circuit is connected to that of a charge pump power source of which a reference potential corresponds to a positive potential of said main power source.

17. The load drive circuit according to claim 12, further comprising:

means that causes said second semiconductor switching element to be turned on before a voltage of said main power source is risen up; and means that allows said first semiconductor switching element to be turned on/off after a voltage of said main power source has risen up to a predetermined voltage.

18. The load drive circuit according to claim 12, wherein said switching command circuit has an update pulse generation circuit that generates pulses to periodically update an on state and/or an off state of said first and/or second semiconductor switching element.

19. An integrated circuit for said load drive circuits according to claim 12, said integrated circuit being formed by integrating semiconductor elements that constitute a main switching circuit including said first and second semiconductor switching elements, said switching command circuit, and said bistable circuit on a semiconductor substrate with said elements isolated by insulating films.

20. A plasma display using said integrated circuit according to claim 19, said integrated circuit being used for a scan circuit that applies a scanning signal for writing designated ones of light-emitting cells and/or an address circuit that specifies presence or absence of light emission of each pixel cell.

* * * * *